US011408080B2

(12) United States Patent
Sturm et al.

(10) Patent No.: US 11,408,080 B2
(45) Date of Patent: Aug. 9, 2022

(54) METHOD OF CLEANING PRETREATMENT OF FERROUS COMPONENTS THAT HAVE BEEN JOINED BY WELDING

(71) Applicant: Henkel AG & Co. KGaA, Duesseldorf (DE)

(72) Inventors: Christoph Sturm, Ruhla (DE); Wilfried Serve, Leverkusen (DE); Stefan Dietz, Gensingen (DE); Thomas John-Schillings, Essen (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 219 days.

(21) Appl. No.: 16/195,192

(22) Filed: Nov. 19, 2018

(65) Prior Publication Data

US 2019/0085469 A1 Mar. 21, 2019

Related U.S. Application Data

(63) Continuation of application No. PCT/EP2017/064063, filed on Jun. 9, 2017.

(30) Foreign Application Priority Data

Jun. 10, 2016 (DE) ..... 102016210289.3

(51) Int. Cl.

| | |
|---|---|
| ***C23C 22/78*** | (2006.01) |
| ***C23G 1/08*** | (2006.01) |
| ***C11D 1/72*** | (2006.01) |
| ***C11D 3/04*** | (2006.01) |
| ***C11D 3/30*** | (2006.01) |
| ***C11D 11/00*** | (2006.01) |

(52) U.S. Cl.

CPC ..... *C23G 1/081* (2013.01); *C11D 1/72* (2013.01); *C11D 3/042* (2013.01); *C11D 3/046* (2013.01); *C11D 3/30* (2013.01); *C11D 11/0029* (2013.01); *C23C 22/78* (2013.01)

(58) Field of Classification Search

CPC ..... C23C 22/78; C11D 1/72

See application file for complete search history.

(56) References Cited

U.S. PATENT DOCUMENTS

| | | | | |
|---|---|---|---|---|
| 6,554,908 | B1 * | 4/2003 | Negri | C23C 22/50 134/28 |
| 7,799,765 | B2 * | 9/2010 | Oku | A23L 29/37 514/53 |
| 2001/0018965 | A1 * | 9/2001 | Matsukawa | F28F 19/02 165/58 |
| 2005/0209117 | A1 * | 9/2005 | Friedrich | C08L 79/08 510/175 |
| 2007/0034606 | A1 * | 2/2007 | Dietsche | C23F 11/04 216/100 |
| 2008/0011323 | A1 | 1/2008 | Fischer et al. | |
| 2010/0222248 | A1 * | 9/2010 | Komp | C23G 1/14 510/258 |
| 2011/0056516 | A1 | 3/2011 | Adair et al. | |

FOREIGN PATENT DOCUMENTS

| | | | |
|---|---|---|---|
| CN | 102653868 | A | 9/2012 |
| CN | 104145049 | A | 11/2014 |
| DE | 2034627 | A1 | 2/1972 |
| DE | 4237021 | C1 | 2/1994 |
| EP | 1050605 | A2 | 11/2000 |
| JP | S56156781 | A | 12/1881 |
| JP | S6026680 | A | 2/1985 |
| JP | S627882 | A | 1/1987 |
| JP | H04269387 | A | 9/1992 |
| JP | 2001220685 | A | 8/2001 |
| WO | 2004065661 | A2 | 8/2004 |

OTHER PUBLICATIONS

The free dictionary, Weld bead, 2003. (Year: 2003).*
Wisegeek, What is a Bead Weld, 2021. (Year: 2021).*
Kiesow Dr. Brinkmann, Phosphating of steel and zinc, 2013. (Year: 2013).*
Allegheny Surface Technology, Pickling vs electropolishing, what's the difference?, Apr. 16, 2020. (Year: 2020).*
International Search Report for PCT/EP2017/064063, dated Sep. 20, 2017.

* cited by examiner

*Primary Examiner* — Hai Y Zhang
(74) *Attorney, Agent, or Firm* — Mary K. Cameron

(57) ABSTRACT

The present invention relates to a method of cleaning pretreatment of ferrous components that have been joined by welding, in which residues from the welding operation are removed from the surface of the component and, in this way, subsequent wet-chemical conversion treatments are enabled so as to produce defect-free coatings. For cleaning pretreatment, the component is contacted with an aqueous sulfuric acid etchant which comprises amino alcohols, ethoxylates and/or propoxylates of fatty alcohols having 6 to 12 carbon atoms in the alcohol and iron ions, and is effective without the presence of fluorides. In a further aspect, the present invention encompasses an aqueous acidic etchant for cleaning pretreatment of ferrous components that have been joined by welding.

20 Claims, No Drawings

METHOD OF CLEANING PRETREATMENT OF FERROUS COMPONENTS THAT HAVE BEEN JOINED BY WELDING

The present invention relates to a method for the cleaning pretreatment of ferrous components joined by welding, in which method residues from the welding process are removed from the surface of the component and, in this way, subsequent wet-chemical conversion treatments are made possible so as to produce defect-free coatings. For the cleaning pretreatment, the component is brought into contact with an aqueous sulfuric pickle liquor which contains amino alcohols, ethoxylates and/or propoxylates of fatty alcohols having 6 to 12 carbon atoms in the alcohol, and iron ions, and which is effective without the presence of fluorides. In a further aspect, the present invention comprises an acidic aqueous pickle liquor for the cleaning pretreatment of ferrous components joined by welding.

Cleaning metal components is a necessary first method step in every industrial stage of production carried out wet-chemically, in order to remove impurities resulting from previous stages of production from the surface of the component and to adapt the surface for subsequent finishing such that high-quality components are made in a reproducible manner. The components are often already assembled from various materials or semi-finished products and have a correspondingly complex geometry. The task of cleaning in a stage of production for the wet-chemical pretreatment of a metal component therefore consists primarily in removing from the surface auxiliaries such as drawing lubricants, anti-corrosion oils, processing liquids from materials processing for shaping in which material is removed or in which material is not removed, or residues from joining methods, and in setting a uniform surface resulting merely from the chemical profile of properties of the metal basic substrate. Depending on the stage of production of the materials used and the loading of the surface with impurities, a number of water-based cleaning agents are in principle commercially available for this purpose, the effect of which is often based on the removal of material by means of pickling, which is enhanced by solubilization of the impurities using surface-active substances. The acidic aqueous cleaning agents disclosed in WO2004/065661 are based on this principle, which agents are intended for metal components having impurities from forming auxiliaries and contain, in addition to an inorganic pH-adjusting builder, a mixture of non-ionic surfactants based on ethoxylated aliphatic alcohols.

Despite the many available cleaning agent formulations which are capable of specifically pickling metal materials and, precisely in this way, also of removing surface impurities, the cleaning of the surfaces of components in the region of the integral bond between materials consisting of iron that is produced by welding so as to provide temporary protection against corrosion or a paint primer during wet-chemical conversion treatment, or phosphating, is problematic since welding residues from slag-forming welding filler materials in particular are only inadequately removed from the surface of the component using conventional cleaning agent formulations. This applies in particular to cleaning agent formulations which are largely free of fluorides and are therefore particularly desirable for reasons relating to environmental protection. Furthermore, from an economic point of view, there is a need for the process temperatures during the cleaning to be kept as low as possible and for the treatment times to be kept as short as possible. A performance spectrum of this kind cannot currently be completely satisfactorily achieved by commercial cleaning agent formulations for the cleaning pretreatment of components joined by welding of materials consisting of iron.

The present invention fulfils this need and establishes a method for the cleaning pretreatment of a component which is assembled at least in part by welding, at least part of the component, which is a material consisting of iron or steel, being integrally bonded to the rest of the component by the welding, in which method the component is brought into contact with an aqueous fluoride-free sulfuric pickle liquor containing a) a total of at least 1 g/kg of amino alcohols;
b) a total of at least 0.5 g/kg of ethoxylates and/or propoxylates of fatty alcohols having 6 to 12 carbon atoms in the alcohol having at least 6 ethylene and/or propylene oxide units; and
c) iron ions.

Within the meaning of the present invention, the term "welding" is the integral bonding of similar or dissimilar metals by applying heat or heat and pressure, and using welding filler materials which produce the integral bond at least in part. Welding filler materials are usually in the form of coated metal wires or filler wires comprising a core and in the form of powders in combination with bare metal wires and have, in addition to the function of facilitating integral bonding by bridging gaps, a protective function during welding which consists in preventing the formation of scale on the melted-down metal constituent of the welding filler material and the materials to be connected in the welding region. In this case, the coating, core or welding powder of the welding filler material often consists of an inorganic, non-metal material which completely surrounds the welding point and the solidifying melt during the welding process and, in this way, provides protection from the surrounding atmosphere. Welding methods according to the invention include all arc welding methods, in particular gas-shielded metal-arc welding (MIG/MAG), tungsten inert gas welding (TIG), spray arc welding and laser and electron-beam welding methods, and combinations of said methods.

It is particularly challenging, in terms of subsequent wet-chemical conversion treatment, to clean regions of the component connected by welding that are, owing to the use of welding filler materials, supplied with silicon, be it in the welding slag located on the surface or in the melted-down metal wire. In the method according to the invention, the component is therefore assembled in particular by means of welding achieved using silicon-containing welding filler materials. In this case, the silicon, as a constituent of the welding filler material, may be an alloy constituent of the wire ("metal electrode"), a chemical constituent of the slag-forming core or coating of the wire ("filling wire electrode" or "rod and wire electrodes") or of welding powder.

According to the invention, cleaning pretreatment of a component which is assembled at least in part by welding in which at least part of the component, which is a material consisting of iron or steel, is integrally bonded to the rest of the component by the welding, at least comprises bringing the region of this/these integral welded joint/s and the directly adjacent region/s into contact with the pickle liquor, preferably bringing the entire component into contact with the pickle liquor. An associated region that surrounds the integral bond by means of the melted-down welding filler ("weld") is directly adjacent to the integral weld joint if, in this region, the average Vickers hardness (VH) according to EN ISO 6507-1:2005, measured using a penetrator which, during proper measurement, does not result in an indentation having a dimension that exceeds the smallest extension of the weld, differs from that of the same material prior to the welding by more than 5%.

The component which undergoes cleaning pretreatment in the method according to the invention is preferably assembled by welding at least in part from steel sheets, steel profiles and/or steel cast parts.

It has surprisingly been found that the residues of the welding filler material ("welding slag") can be effectively removed from the component by means of a sulfuric pickle liquor based on a combination of amino alcohols and non-ionic surfactants selected from fatty alcohols, without highly complexing fluorides, which should be classified as problematic for reasons relating to environmental protection, having to be present.

According to the invention, a sulfuric pickle liquor is characterized in that the pH thereof is below 2.0, preferably below 1.0, and at least 20 g/kg of sulfuric acid, preferably at least 40 g/kg of sulfuric acid, calculated as $SO_4$, is contained, the proportion of other acids having a $pK_{S1}$ value of less than 2.0, and the anions thereof based on the equivalent of sulfuric acid calculated as $SO_4$, is preferably less than 5 g/kg in total, particularly preferably less than 1 g/kg in total. In a preferred embodiment, the sulfuric pickle liquor contains at least 60 g/kg, but, for economic reasons, preferably less than 120 g/kg, particularly preferably less than 90 g/kg, of sulfuric acid calculated as $SO_4$.

The sulfuric pickle liquor used in the method according to the invention is also fluoride-free, which means that a total of less than 50 mg/kg, preferably less than 10 mg/kg, particularly preferably less than 1 mg/kg, of fluoride ions are contained, it being possible to determine the proportion of fluoride ions in a TISAB-buffered aliquot portion of the pickle liquor using a fluoride-sensitive electrode at 20° C. (TISAB: "Total Ionic Strength Adjustment Buffer"), the mixture ratio of buffer to the aliquot portion of the pickle liquor by volume being 1:1. The TISAB buffer is prepared by dissolving 58 g NaCl, 1 g sodium citrate and 50 ml glacial acetic acid in 500 ml deionized water ($\kappa<1\ \mu Scm^{-1}$), setting a pH of 5.3 using 5 N NaOH and filling to a total volume of 1000 ml, again with deionized water ($\kappa<1\ \mu Scm^{-1}$).

With regard to the amino alcohols according to component a) as an essential constituent of the pickle liquor, 1,3-amino alcohols and the ethylene or 1,2-proplyene glycol monoethers thereof, such as 2-(2-aminoethoxy)ethanol, 2-(2-aminoethoxy)propanol, in particular have been found to be effective, and therefore the use thereof is preferred in the method according to the invention, 1,3-amino alcohols being particularly preferred. 1,3-amino alcohols are preferably selected from dimethylaminoethanol, diethylaminoethanol, N-methyldiethanolamine, mono-, di- and/or triethanolamine, and mono-, di- and triisopropanolamine. Particularly preferred in this context are mono-, di- or triethanolamine and mixtures thereof. In this context, a pickle liquor containing both triethanolamine and monoethanolamine has been found to be advantageous.

In order for the components joined by welding to be sufficiently pickled, according to the invention, it is preferable for the proportion of amino alcohols, particularly preferably 1,3-amino alcohols and the ethylene or 1,2-propylene glycol monoethers thereof, particularly preferably 1,3-amino alcohols, to be at least 2 g/kg, particularly preferably at least 4 g/kg, but preferably to not exceed 20 g/kg, particularly preferably 10 g/kg, for economic reasons. Particularly preferred are methods in which at least 80 wt. %, preferably at least 90 wt. %, of all 1,3-amino alcohols, preferably all 1,3-amino alcohols and the ethylene or 1,2-propylene glycol monoethers thereof, particularly preferably all amino alcohols, in the pickle liquor are selected from mono-, di- and/or triethanolamine.

In the method according to the invention, in order for the welding slag to be removed from the components to be cleaned, it is also essential for the non-ionic surfactant according to component b) to be present in the pickle liquor.

For this purpose, it is advantageous if the non-ionic surfactants have a particular HLB value which promotes effective wetting of the components and separation and dispersion of the welding slag during the pickling process. In this respect, methods are preferred in which the ethoxylates and/or propoxylates of the fatty alcohols according to component b) have an HLB value of less than 16, particularly preferably less than 14, but preferably more than 10. The HLB value (hydrophilic-lipophilic balance) is an empirical variable and is calculated as follows:

$$HLB=20\cdot(1-M_L/M)$$

where $M_L$ is molar mass of the lipophilic group of the non-ionic surfactant; M is molar mass of the non-ionic surfactant.

In a preferred embodiment of the method according to the invention, the ethoxylates and/or propoxylates of the fatty alcohols according to component b) are selected from ethoxylates, preferably from ethoxylates of fatty alcohols having 8 to 10 ethylene oxide units and having 8 to 12 carbon atoms in the aliphatic functional group of the fatty alcohol.

In methods according to the invention, a proportion of ethoxylates and/or propoxylates of fatty alcohols according to component a) in the pickle liquor of at least 1 g/kg is advantageous in terms of achieving a sufficient effect, and is therefore preferred. Particularly preferably, the proportion of fatty alcohols according to component b) in the pickle liquor is at least 2 g/kg, but preferably no more than 10 g/kg, particularly preferably no more than 6 g/kg, for economic reasons.

The simultaneous presence of such ethoxylates and/or propoxylates of fatty alcohols in the pickle liquor that contain 6 to 12 carbon atoms in the fatty alcohol and less than 6 ethylene and/or propylene oxide units has been found to also be advantageous for the removal of the welding slag from the surfaces of the component. Pickle liquors of this kind should therefore preferably be used in the method according to the invention, the proportion by mass thereof relative to the proportion of component b) preferably being in the range of from 1:10 to 4:10.

In methods according to the invention, it is also necessary for iron ions to be present in the pickle liquor in order for a pickling action to be achieved on the component in a supporting manner and thus for welding slag to be removed from the component within economically viable time periods. Accordingly, methods according to the invention are preferred in which at least 10 g/kg of iron ions are contained in the pickle liquor. At the same time, precipitation of iron(III) hydroxides on the surfaces of the component during pickling should be avoided, and therefore, according to the invention, preferably no more than 70 g/kg, particularly preferably no more than 50 g/kg, of iron ions should be contained in the pickle liquor.

In this case, water-soluble salts, preferably water-soluble salts of iron(II) ions, particularly preferably iron(II) sulfate, are used as the source of iron ions. Alternatively, iron powder of a sulfuric pickle liquor containing components a) and b) can also be added, a quantity of iron ions being released thereby. In the latter case, owing to the acid consumption, the pH of the sulfuric pickle liquor can be reset, if required.

It is also preferable for the metal surfaces of the component not to be pre-passivated in the method according to the invention during the pickling process, and for the surfaces of the cleaned and quasi bright metal surfaces of the component to only be subject to wet-chemical conversion treatment at a later stage. In a preferred method according to the invention, a total of less than 1 g/kg, preferably less than 0.1 g/kg, particularly preferably less than 0.01 g/kg, of dissolved phosphates, calculated as $PO_4$, are therefore contained in the pickle liquor. For the same reason, a total of preferably less than 0.01 g/kg, particularly preferably less than 0.001 g/kg, of water-soluble compounds of elements Zr and/or Ti, are contained in the pickle liquor, based on the particular element in each case.

In order for organic surface impurities to be completely removed, it is preferable for pickling to be preceded, in the method according to the invention, by alkaline degreasing of the component, particularly preferably immediately preceded by said alkaline degreasing with an intermediate rinsing step, the alkaline degreasing being carried out at a pH of at least 10.

According to the invention, a rinsing step is always used to remove, by means of a water-based liquid medium, water-soluble residues, not firmly adhering chemical compounds and loose solid particles from the component to be cleaned that were carried over from a preceding wet-chemical treatment step, for example the alkaline degreasing, together with the wet film adhering to the component. In this case, the water-based liquid medium does not contain any chemical components that bring about significant surface coverage of the components produced from metal materials with subgroup elements, metalloid elements or polymeric organic compounds. Such significant surface coverage would occur in any case if the liquid rinsing medium were to deplete these components by at least 10 milligrams per square meter of the rinsed surfaces, preferably by at least 1 milligram per square meter of the rinsed surfaces, with respect to the particular element or the particular polymeric organic compound, without considering gains through carryover and losses through removal by wet films adhering to the component.

As already mentioned in the context of the present invention and as discussed in connection with the problem addressed by the invention, the cleaning pretreatment of the component is used in particular to prepare said component for a wet-chemical conversion treatment during which a passivating layer which is as homogeneous as possible and improves paint adhesion is produced on the surfaces of the component and in particular on the regions thereof that have impurities from the welding slag. Therefore, according to the invention, methods are preferred in which the pickling is followed by a wet-chemical conversion treatment of the component, preferably again immediately followed by said treatment with or without an intermediate rinsing and/or drying step, particularly preferably without an intermediate drying step.

According to the invention, a drying step is any method step in which drying of the aqueous liquid film adhering to the surface of the component assembled by welding is brought about by providing and using technical means, particularly by supplying thermal energy or applying an airflow.

According to the invention, wet-chemical conversion treatment is understood to mean bringing at least the iron or steel surfaces of the component into contact with an aqueous composition which produces a passivating and substantially inorganic conversion coating on the surfaces of the treated iron or steel materials. In this case, a conversion coating is any inorganic coating on the iron or steel surfaces of the component which is not an oxidic or hydroxidic coating and of which the main cationic constituents are iron ions. A conversion coating may therefore be an iron phosphate layer.

According to the invention, the wet-chemical conversion treatment is preferably carried out by means of acidic aqueous compositions of which the pH is above 1, but below 5, and is preferably layer-forming phosphating. According to the invention, layer-forming phosphating is a form of phosphating which results in a coating layer, calculated as $PO_4$, of at least 0.5 $g/m^2$. Such forms of phosphating are well known to a person skilled in the art of surface treatment, for example as zinc phosphating or what is referred to as tricationic phosphating.

According to the invention, an above-described wet-chemical conversion treatment is in turn preferably followed by dip coating of the component, preferably electrocoating, with or without an intermediate rinsing and/or drying step, preferably without an intermediate drying step.

In a further aspect, the present invention comprises an acidic aqueous pickle liquor which can be particularly suitably used in the method according to the invention for the cleaning pretreatment of components which have integral bonds between materials consisting of iron and/or steel that have been produced by welding.

Such pickle liquors according to the invention have a pH below 2.0 and contain:

i) 40 to 120 g/kg, preferably 60 to 90 g/kg, of sulfuric acid, calculated as $SO_4$;
ii) 2 to 20 g/kg, preferably 4 to 10 g/kg, of amino alcohols;
iii) 0.5 to 5 g/kg, preferably 1 to 3 kg/g, of ethoxylates and/or propoxylates of fatty alcohols having 6 to 12 carbon atoms in the alcohol having at least 6 ethylene and/or propylene oxide units;
iv) 10 to 50 g/kg iron ions;
v) less than 50 mg/kg, preferably less than 10 mg/kg, particularly preferably less than 1 mg/kg, of fluoride ions;
vi) less than 1 g/kg, preferably less than 0.1 g/kg, particularly preferably less than 0.01 g/kg, of dissolved phosphates, calculated as $PO_4$.

The embodiments of components a) to c) of the sulfuric pickle liquor which have already been mentioned in the context of the method according to the invention in terms of the preferred chemical structure are also preferred embodiments of components ii) to iv) of the acidic aqueous pickle liquor according to the invention.

In a preferred embodiment, 0.5 to 5 g/kg, preferably 1 to 3 g/kg, of ethoxylates and/or propoxylates of fatty alcohols having 6 to 12 carbon atoms in the alcohol having less than 6 ethylene and/or propylene oxide units are additionally contained as component vii) in the pickle liquor according to the invention.

An acidic aqueous pickle liquor according to the invention preferably contains less than 1 wt. %, preferably less than 0.1 wt. %, of components other than components i) to vi).

EMBODIMENTS

Test pieces assembled from two cut-out steel sheets (200×200×2 mm) by means of metal active gas welding (mixture gas M20: 90% argon, 10% $CO_2$) were treated according to the process steps defined below. The welding was carried out in accordance with the AWS A 5.28/A 5.28M:2007 standard using a slag-forming silicon-containing welding filler material. The welding bead had a length of approximately 100 mm and a width of approximately 2-3 mm.

A. Alkaline degreasing:

The test piece was immersed in a mixture of Bonderite® C-AD 1563 (3 wt. %) and Bonderite® C-AD 1400 (0.3 wt. %) at 65° C. for 10 minutes.

B. Acidic pickle liquor:

B.1 The test piece was immersed at 60° C. for 4 minutes in a sulfuric pickle liquor containing:

| | | |
|---|---|---|
| a) | 77.8 g/kg | $H_2SO_4$ |
| b) | 1.5 g/kg | ethoxylated (8EO) fatty alcohol (C10) |
| c) | 20 g/kg | iron(II) sulfate |
| d) | 0.45 g/kg | ethoxylated (4EO) fatty alcohol (C8) |

B.2 The test piece was immersed at 60° C. for 15 minutes in a mixed-acid pickle liquor containing:

| | | |
|---|---|---|
| a) | 150 g/kg | $H_2SO_4$ |
| b) | 70 g/kg | $H_3PO_4$ |
| c) | 40 g/kg | iron(II) sulfate |
| d) | 1.8 g/kg | ammonium bifluoride |

C. Zinc phosphating:

The test piece was immersed in Bonderite® M-ZN 958 at 52° C. for 4 minutes, the test piece being activated, however, immediately before with Bonderite® M-AC 950 at 25° C. for 1 minute, with an intermediate step of rinsing with deionized water ($\kappa<1$ $\mu Scm^{-1}$).

In a process sequence A-B.1-C according to the invention, a shiny metal surface was obtained in the region of the weld seam. A minimal amount of residue from the welding slag could only be seen in this region using an optical microscope. Scanning electron microscopy (SEM) confirmed the good overall optical result and proved by means of energy-dispersive X-ray spectroscopy (EDX) that small amounts of silicon could still only be detected in portions.

By contrast, despite the tripled treatment time in a conventional process sequence A-B.2-C using a fluoride-containing mixed-acid pickle liquor, residues of the welding slag were perceptible even to the naked eye as matte points. Optical microscopy and REM confirmed this. Furthermore, a zinc phosphate layer was not formed on the regions on which residues of the welding slag were identified by the naked eye before and immediately after pickling.

What is claimed is:

1. A method for cleaning pretreatment of a component assembled at least in part by welding, comprising: contacting the component assembled at least in part by welding, wherein at least one portion of the component comprises a material consisting of iron or steel integrally bonded to another portion of the component by welding, with an aqueous fluoride-free sulfuric pickle liquor containing:

a) a total of at least 1 g/kg of amino alcohols per the aqueous fluoride-free sulfuric pickle liquor;

b) a total of at least 0.5 g/kg of ethoxylates and/or propoxylates of fatty alcohols having 6 to 12 carbon atoms in the fatty alcohol and comprising at least 6 ethylene and/or propylene oxide units per the aqueous fluoride-free sulfuric pickle liquor; and c) iron ions wherein the sulfuric pickle liquor has a pH below 2.0 and includes at least 20 g/kg of sulfuric acid.

2. The method according to claim 1, wherein the amino alcohols according to component a) are selected from 1,3-amino alcohols and the ethylene or 1,2-propylene glycol monoethers thereof.

3. The method according to claim 1, wherein component a) is present in an amount of at least 2 g/kg, but not more than 20 g/kg of the aqueous fluoride-free sulfuric pickle liquor.

4. The method according to claim 1, wherein the ethoxylates and/or propoxylates of the fatty alcohols according to component b) have an HLB value of less than 16 and more than 10.

5. The method according to claim 1, wherein the ethoxylates and/or propoxylates of the fatty alcohols according to component b) are selected from ethoxylates.

6. The method according to claim 1, wherein the ethoxylates and/or propoxylates of the fatty alcohols according to component b) are selected from ethoxylates of fatty alcohols having 8 to 12 carbon atoms in the fatty alcohol and having 8 to 10 ethylene oxide units.

7. The method according to claim 1, wherein the proportion of ethoxylates and/or propoxylates of fatty alcohols according to component b) in the aqueous fluoride-free sulfuric pickle liquor is at least 1 g/kg and no more than 10 g/kg of the aqueous fluoride-free sulfuric pickle liquor.

8. The method according to claim 1, wherein the aqueous fluoride-free sulfuric pickle liquor further comprises ethoxylates and/or propoxylates of fatty alcohols having 6 to 12 carbon atoms in the fatty alcohol having less than 6 ethylene and/or propylene oxide units.

9. The method according to claim 1, wherein component c) is present in an amount of at least 10 g/kg and no more than 70 g/kg of the aqueous fluoride-free sulfuric pickle liquor.

10. The method according to claim 1, wherein the aqueous fluoride-free sulfuric pickle liquor contains a total of less than 1 g/kg dissolved phosphates, calculated as PO4, per the aqueous fluoride-free sulfuric pickle liquor.

11. The method according to claim 1, wherein the contacting with the aqueous fluoride-free sulfuric pickling liquor is preceded by alkaline degreasing of the component, the alkaline degreasing being carried out at a pH of at least 10.

12. The method according to claim 1, wherein the contacting with the aqueous fluoride-free sulfuric pickling liquor is followed by a wet-chemical conversion treatment of the component.

13. The method according to claim 12, wherein the wet-chemical conversion treatment is carried out by means of acidic aqueous compositions having a pH of greater than 1, but below 5.

14. The method according to claim 1, wherein the amino alcohols according to component a) include a 1,3-amino alcohol selected from 2-(2-aminoethoxy)ethanol, 2-(2-aminoethoxy)propanol, dimethylaminoethanol, diethylaminoethanol, N-methyldiethanolamine, monoethanolamine, diethanolamine, triethanolamine, monoisopropanolamine, diisopropanolamine, triisopropanolamine and combinations thereof.

15. The method according to claim 14, wherein at least 80 wt. % of the 1,3 amino alcohol is selected from monoethanolamine, diethanolamine, triethanolamine and combinations thereof.

16. The method according to claim 1, further comprising ethoxylates and/or propoxylates of fatty alcohols, having 6 to 12 carbon atoms in the fatty alcohol and less than 6 ethylene and/or propylene oxide units, present in an amount of 0.5 to 5 g/kg of the aqueous fluoride-free sulfuric pickle liquor.

17. The method according to claim 1, wherein the iron ions according to component c) are sourced from iron(II) sulfate.

18. The method of claim 1, wherein the sulfuric acid is present in an amount of at least 60 g/kg and less than 120 g/kg.

19. The method of claim 1, wherein the aqueous fluoride-free sulfuric pickle liquor has a pH below 1.0.

20. An acidic aqueous pickle liquor having a pH of below 2.0 and containing:

i) 40 to 120 g/kg of sulfuric acid, calculated as SO4;

ii) 2 to 20 g/kg of amino alcohols;

iii) 0.5 to 5 g/kg of ethoxylates and/or propoxylates of fatty alcohols having 6 to 12 carbon atoms in the fatty alcohol and at least 6 ethylene and/or propylene oxide units;

iv) 10 to 50 g/kg iron ions;

v) less than 50 mg/kg of fluoride ions;

vi) less than 1 g/kg of dissolved phosphates, calculated as PO4.

* * * * *